US005923116A

United States Patent [19]

Mercer et al.

[11] Patent Number: 5,923,116

[45] Date of Patent: Jul. 13, 1999

[54] REFLECTOR ELECTRODE FOR ELECTRODELESS BULB

[75] Inventors: William Burton Mercer, Spring; Dale S. Walker; Richard M. Knox, both of Houston, all of Tex.

[73] Assignee: Fusion Lighting, Inc., Rockville, Md.

[21] Appl. No.: 08/771,600

[22] Filed: Dec. 20, 1996

[51] Int. Cl.[6] ..... H01J 5/16

[52] U.S. Cl. ..... 313/113; 313/110; 313/114; 313/635; 313/493

[58] Field of Search ..... 313/110, 113, 313/114, 607, 631, 635, 283, 19, 491, 493; 315/248

[56] References Cited

U.S. PATENT DOCUMENTS

| | | | |
|---|---|---|---|
| 3,046,432 | 7/1962 | Nehrich | 313/113 |
| 5,117,160 | 5/1992 | Konda et al. | 313/607 |
| 5,309,058 | 5/1994 | Heindl et al. | 313/607 |
| 5,438,343 | 8/1995 | Khan et al. | 313/493 |
| 5,514,934 | 5/1996 | Matsumoto et al. | 313/607 |
| 5,666,026 | 9/1997 | Matsuno et al. | 313/607 |

*Primary Examiner*—Vip Patel

[57] ABSTRACT

A lamp apparatus includes an electrodeless bulb that includes a chamber, a gas contained within the chamber in the bulb, and at least one reflector electrode adjacent the bulb for transmitting radio-frequency electromagnetic energy to the gas in the bulb to excite the gas and cause it to radiate light and for reflecting the light radiated from the bulb. Preferably, there are two reflectors electrodes. The bulb can advantageously be made of a tube, in which case the reflectors electrodes can be made shorter than the bulb and centered thereon so that the intense heat caused by the plasma when the gas is excited does not reach the ends of the bulb.

35 Claims, 5 Drawing Sheets

REFLECTOR ELECTRODE FOR ELECTRODELESS BULB

BACKGROUND OF THE INVENTION

1. Field of the Invention

The present invention relates to highly efficient lamps. More particularly, the present invention relates to a high power lamp which includes an envelope and exterior electrodes.

2. Description of the Related Art

High power lamps are used for illumination applications beyond typical incandescent and fluorescent lamps. One type of lamp known as a high intensity discharge (HID) lamp consists of a glass envelope which contains electrodes and a fill which vaporizes and becomes a gas when the lamp is operated.

Recently, a patent issued for a high power lamp that utilizes a lamp fill containing sulfur or selenium or compounds of these substances. U.S. Pat. No. 5,404,076, issued to Dolan, et al., and entitled "Lamp Including Sulfur" discloses an electrodeless lamp utilizing an excited fill. The Dolan, et al., U.S. Pat. No. 5,404,076 is incorporated herein by reference.

Projecting systems are used to display images on large surfaces, such as movie or television screens and computer displays. For example, in a front projection system, an image beam is projected from an image source onto the front side of a reflection-type angle transforming screen, which then reflects the light toward a viewer positioned in front of the screen. In a rear projection system, the image beam is projected onto the rear side of a transmission-type angle transforming screen and transmitted toward a viewer located in front of the screen.

In prior co-pending U.S. patent application Ser. No. 08/581,108, entitled "Projecting Images," to Knox, filed Dec. 29, 1995, there is disclosed a method of displaying an optical image by projecting the image along an optical path and at an optical device interposed across the optical path, at one time reflecting the image from the optical device and at a different time permitting the image to pass through the optical device to be displayed. U.S. patent application Ser. No. 08/581,108, filed Dec. 29, 1995, is incorporated herein by reference. A projection system for such a display is disclosed in U.S. application Ser. No. 08/730,818, entitled "Image Projection System Engine Assembly," to Knox, filed Oct. 17, 1996, which is hereby incorporated by reference.

The image source for a projection system employs a light that must be of high intensity and preferably very efficient. Such a light is disclosed in U.S. patent application Ser. No. 08/747,190, entitled "High Efficiency Lamp Apparatus for Producing a Beam of Polarized Light," to Knox, et al., filed Nov. 12, 1996, which is hereby incorporated by reference. If an optical image is to be displayed by projection, it sometimes passes through an optical device interposed across the optical path. In the projection system of prior co-pending application Ser. No. 08/581,108, filed Dec. 29, 1995, one or more optical devices reflect the image at one time from the optical device and at a different time permit the image to pass through the optical device to be displayed. There will be a decrease in light intensity once the optical image strikes the optical device interposed across the optical path.

While the lamp disclosed in U.S. Pat. 5,404,076 is very efficient, it was intended for a general lighting environment, not for a projection display system. As such, the design would be inefficient, so a more efficient design of the lamp is desirable for other environments, including projection display systems.

SUMMARY OF THE INVENTION

According to the present invention, a lamp apparatus is provided having an electrodeless bulb that includes a chamber, a gas contained within the chamber in the bulb, and at least one reflector electrode adjacent the bulb for transmitting electromagnetic energy to the gas in the bulb to excite the gas and cause it to radiate light and for reflecting the light radiated from the bulb. The bulb is preferably made of quartz, but can be made of other transparent material which can withstand the heat generated by the gas when it is excited by radio-frequency electromagnetic energy. The reflector electrode preferably has a metal which can withstand the heat generated by the gas when it is excited by radio-frequency electromagnetic energy which reaches the exterior of the lamp where the reflector electrode is. The bulb can be a quartz envelope, such as a quartz sphere or a quartz tube.

The lamp apparatus preferably includes two reflector electrodes adjacent the bulb. In a preferred embodiment, the bulb is a tube having a first end and a second end, and the reflector electrodes are approximately centered and are spaced from the first end and the second end of the tube to allow the ends to be relatively cool compared to the center of the tube.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

FIGS. 1–4 show generally an embodiment of the apparatus of the present invention designated generally by the numeral 10R. A high efficiency lamp 10R includes a bulb 11 having a hollow interior 12 that contains a fill such as sulfur or selenium or their compounds. The bulb 11 is preferably a transparent sphere. The bulb 11 can be made of quartz or sapphire for example. Another type of bulb that can be used is a non mercury containing metal halide lamp bulb.

The fill in the bulb 11 can be excited to a plasma state so as to produce a high intensity light source. The fill is excited at a power density appropriate for the fill materials, pressures, and size of the bulb 11.

Figure 1:
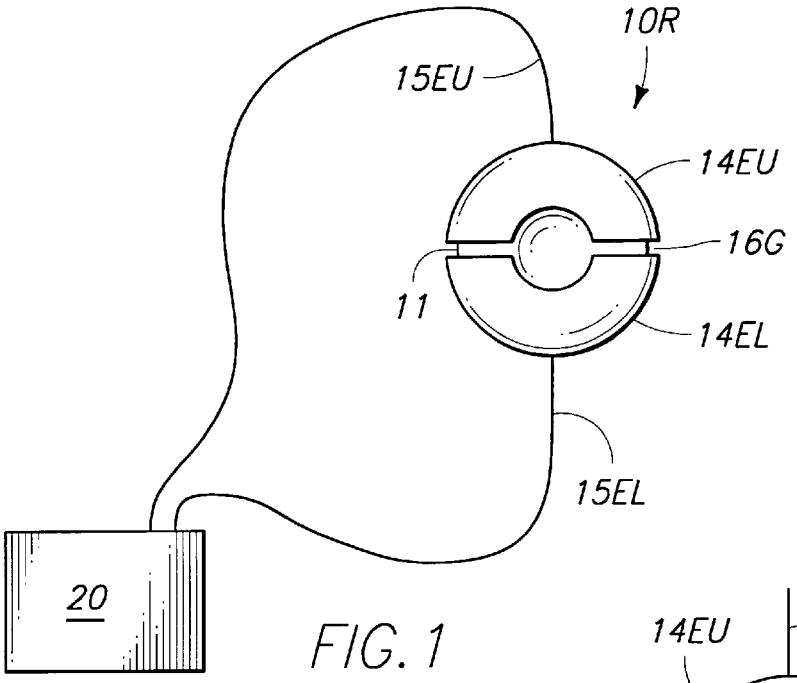
FIG. 1 is a front view of the preferred embodiment of the apparatus of the present invention.
Figure 2:
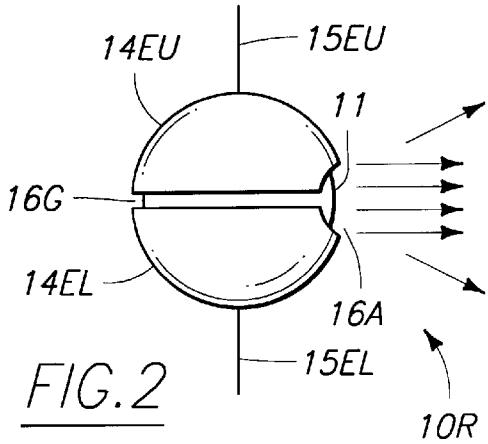
FIG. 2 is a side view of the preferred embodiment of the apparatus of the present invention.
Figure 3:
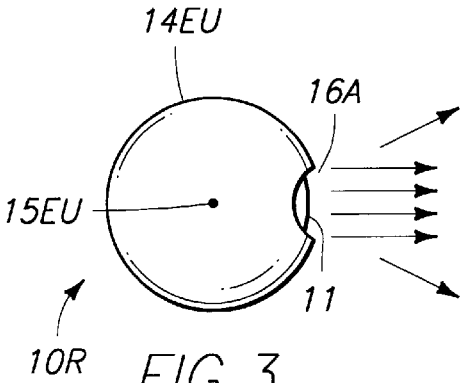
FIG. 3 is a top view of the preferred embodiment of the apparatus of the present invention.
Figure 4:
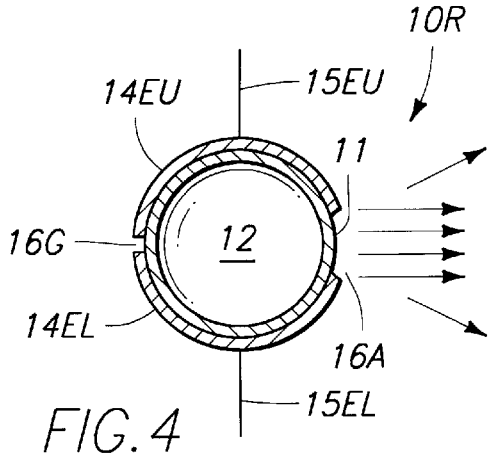
FIG. 4 is a sectional elevational side view of the preferred embodiment of the apparatus of the present invention.
Figure 4A:
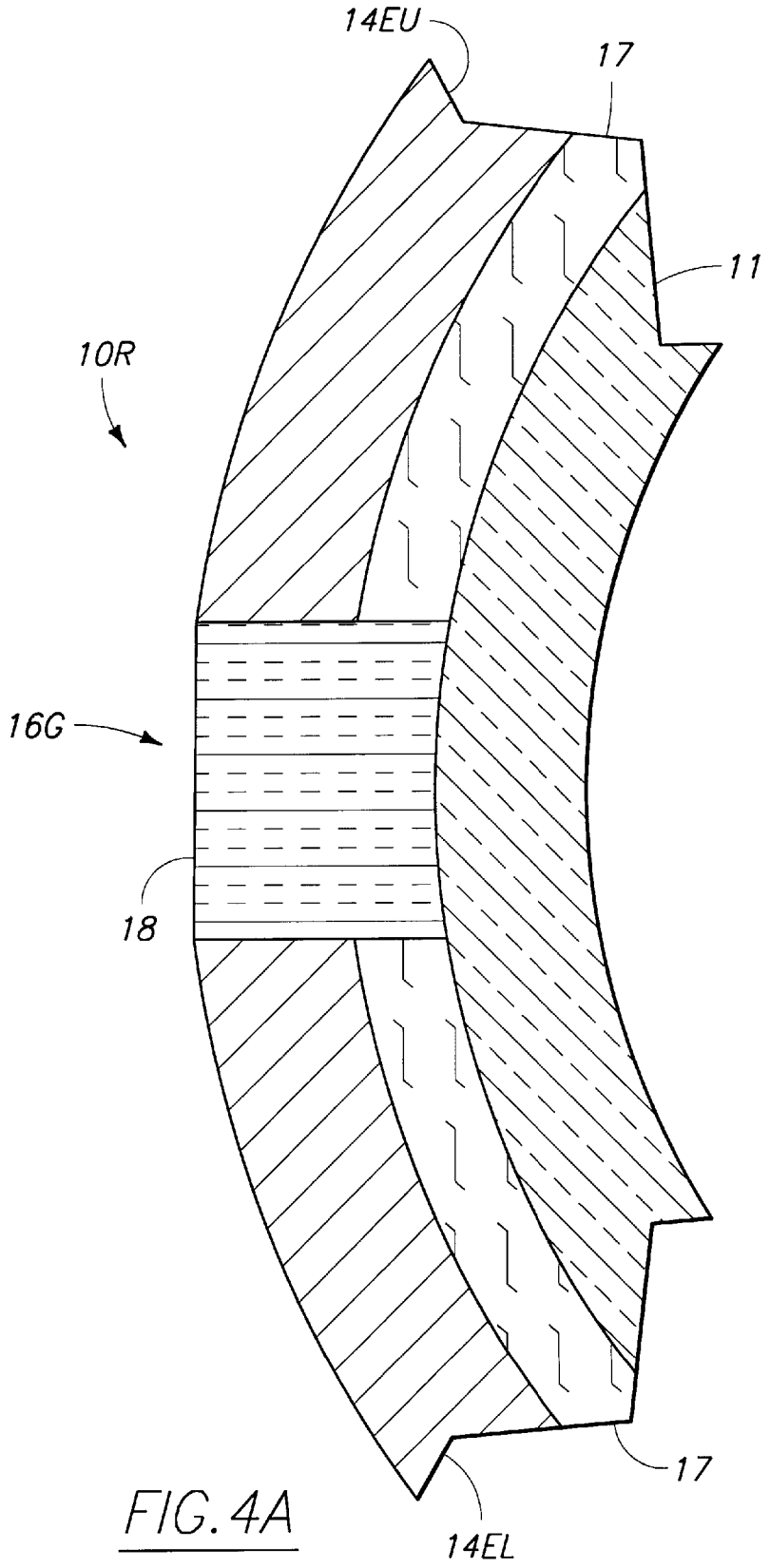
FIG. 4A is an enlarged, fragmented sectional view of an alternative construction of the preferred embodiment of the apparatus of the present invention.
Figure 5:
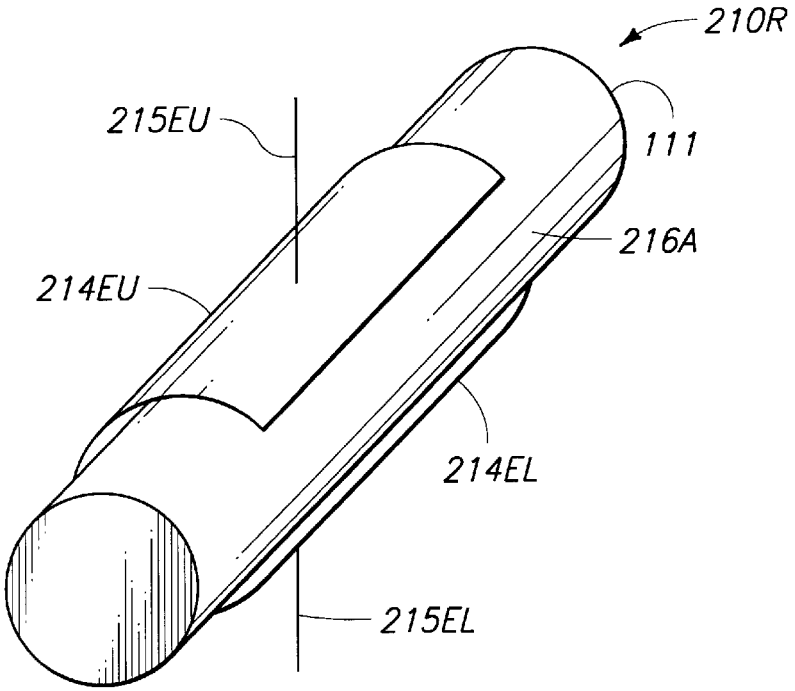
FIG. 5 is a perspective view of a second embodiment of the apparatus of the present invention.
Figure 6:
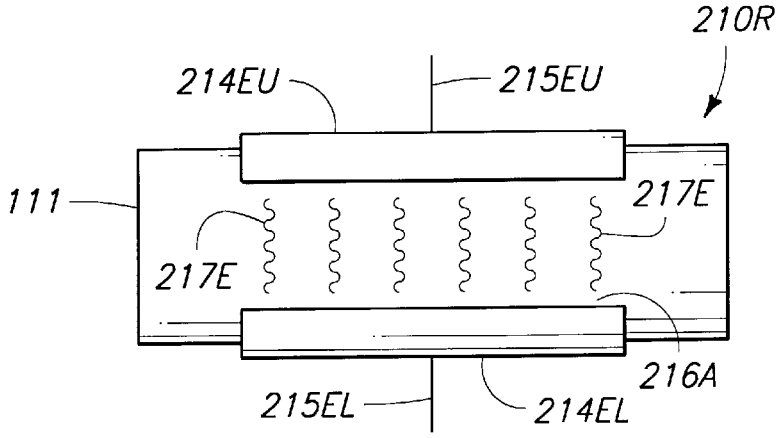
FIG. 6 is a front elevational view of the second embodiment of the apparatus of the present invention.
Figure 7:
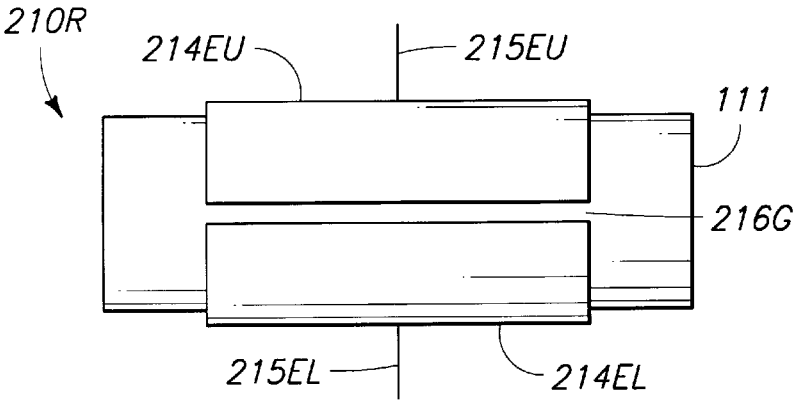
FIG. 7 is a rear elevational view of the second embodiment of the apparatus of the present invention.
Figure 8:
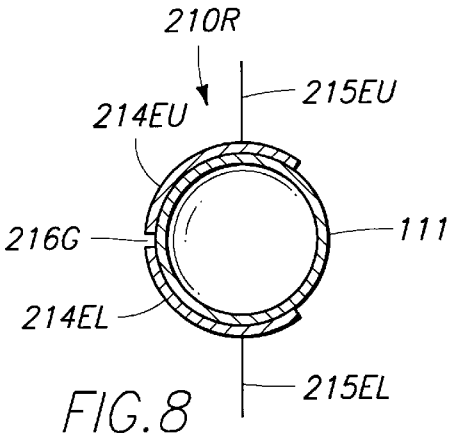
FIG. 8 is a sectional elevational side view of the second embodiment of the apparatus of the present invention.

Attached to the bulb 11 are an upper reflector electrode 14EU and a lower reflector electrode 14EL. The reflector electrodes 14EU and 14EL can withstand the intense heat of between about 800 and 1200° C. which is present on the outer surface of the bulb 11. The reflector electrodes 14EU and 14EL serve both as electrodes through which radio frequency (or other suitable frequency) energy is provided to excite the gas fill to generate a plasma of intense heat and which emits light of extremely high brightness and as reflectors to reflect this bright light. The plasma within the bulb 11 is preferably capable of reabsorbing the reflected light and re-emitting that light. This redirected light can include ultraviolet and infrared radiation as well as visible radiation. The redirected light is used to increase the efficiency of the light source through an optical pumping effect. Wave guides 15EU and 15EL connect the reflector electrodes 14EU and 14EL to a source 20 of radio frequency energy (such as microwave energy). The reflector electrodes 14EU and 14EL can be formed separately and then attached to the bulb 11. Further, the reflector electrodes 14EU and 14EL can be coated with a diffusely reflecting material 17, such as a ceramic, as shown in FIG. 4A.

There is a gap 16G between the upper reflector electrode 14EU and the lower reflector electrode 14EL. This gap 16G prevents a short circuit between the upper reflector electrode 14EU and the lower reflector electrode 14EL, and is preferably kept as small as possible to achieve this purpose. Alternatively, this gap can be filled with reflective but nonconductive material 18, as shown in FIG. 4A.

There is an aperture 16A through which most of the light exiting the bulb 11 passes. The aperture 16A is formed in the upper reflector electrode 14EU and the lower reflector electrode 14EL.

In operation, radio frequency energy supplied by the radio frequency source 20 (such as at microwave frequencies) is conducted through the wave guides 15EU and 15EL. The reflector electrodes 14EU and 14EL then act as antennas, transmitting the radio frequency energy to the fill in the bulb 11. This radio frequency energy excites the gas fill in the bulb 11, causing bulb 11 to emit extremely bright light.

FIGS. 5–8 show a second embodiment of the apparatus of the present invention, a high efficiency lamp 210R. The lamp 210R is similar to the lamp 10R and can be constructed of the same materials and in the same manner. However, the lamp 210R includes a cylindrical tube bulb 111 instead of the spherical bulb 11 of the lamp 10R and correspondingly shaped reflector electrodes 214EU and 214EL. Lamp 210R is designed to include a thermal barrier between the plasma generated in the bulb 111 and the ends of bulb 111.

Wave guides 215EU and 215EL connect the reflector electrodes 214EU and 214EL, respectively, to a source of radio frequency energy. There is a gap 216G similar to the gap 16G of lamp 10R and an aperture 216A similar to the aperture 16A of lamp 10R. As one can see in FIGS. 5–7, the reflector electrodes 214EU and 214EL do not extend the entire length of the bulb 111, but rather are spaced inwardly from the ends thereof. The reflector electrodes 214EU and 214EL are made shorter than the bulb 111 because, by stopping the electrodes short, one also stops short the plasma generated by the radio frequency energy 217E passing between the reflector electrodes 214EU and 214EL. Thus, the plasma does not extend to the ends of the bulb 111 and the ends of the bulb 111 are cooler than the middle of the bulb 111.

Figure 9:
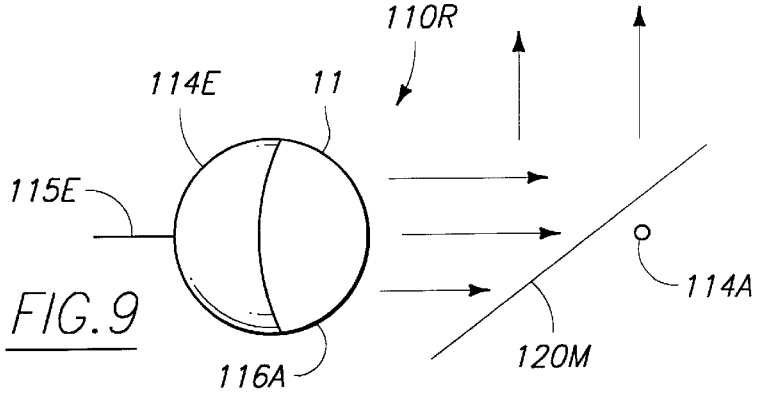
FIG. 9 is a perspective view of a third embodiment of the apparatus of the present invention.

FIG. 9 shows a third embodiment of the present invention, a lamp 110R. The lamp 110R is similar to the lamp 10R in that it includes a spherical bulb 11. Also, the reflector electrode 114E is similar to the reflector electrodes 14EU and 14EL, but the second electrode is not a reflector, but rather is an antenna 114A spaced away from the bulb 11. As can be seen in FIG. 9, the antenna 114A is separated from the bulb 11 of the lamp 110R by a mirror 120M. A wave guide 115E connects the reflector electrode 114E to a source of radio frequency energy. The antenna 114A is likewise connected to a source of radio frequency energy. The aperture 116A is smaller than the diameter of the bulb 11. In such a case, the reflector electrode 114E could be formed by deposition on the bulb 11. If the aperture 116A were made larger than the diameter of the bulb 11, then the reflector electrode 114E could be made separately and then attached to the bulb 11.

Lamp 110R is advantageous because it has no gap similar to the gaps 16G and 216G through which light can leak from the bulbs 11 and 111. The mirror 120M should be substantially transparent to the radio frequency energy which will pass between the antenna 114A and the reflector electrode 114E to excite the gas fill in the bulb 11, but should also be reflective of substantially all light passing through the aperture 116.

Figure 10:
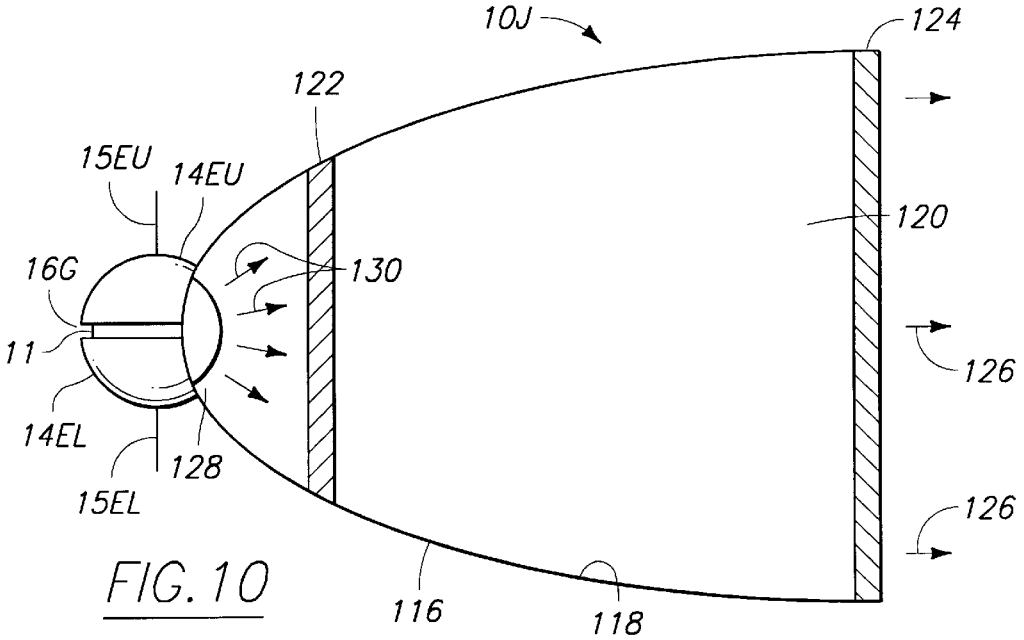
FIG. 10 is a sectional view of a fourth embodiment of the apparatus of the present invention.

A fourth embodiment of the apparatus of the present invention is shown in FIG. 10 and is designated as 10J. The light apparatus 10J includes the lamp 10R of FIGS. 1–4 attached to a first narrow end of a reflector housing 116. The reflector housing 116 forms an inner reflecting surface 118 with an open end 120. A screen element 122 is a dichroic filter or dichroic mirror for only passing certain colors of light. A screen element 124 is a reflecting polarizer that only passes one selected polarity of light. Arrows 126 indicate a light emitted by the apparatus 10J as being light of a desired color (such as red, green, and blue) and that is polarized with a single polarity. The light apparatus 10J, however, includes the lamp 10R situated within an opening 128 of the reflective housing 116. Due to the reflector electrodes 14EU and 14EL, the lamp 10R includes its own directional aspects, emitting light only in the direction specified by the arrows 130.

The light apparatus 10J can advantageously be used as a source of polarized light for applications which require polarized light, such as the Projector Lamp Optics Assembly disclosed in co-pending patent application Ser. No. 08/730,818, entitled "Image Projection System Engine Assembly," to Knox, filed Oct. 17, 1996. Light apparatus 10J might also be a colored light source.

Figures 11, 12:
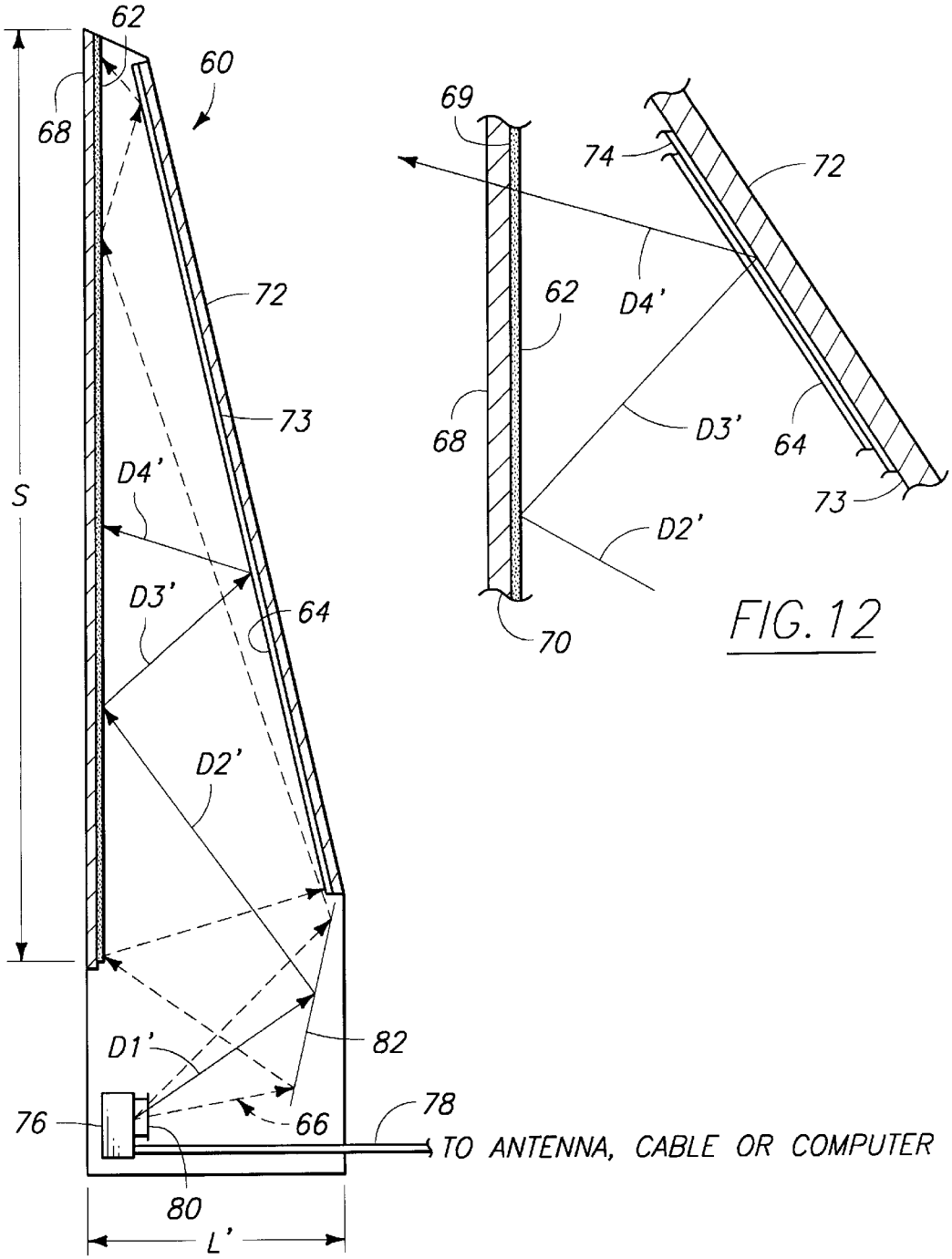
FIGS. 11 and 12 are side views of a system suitable for use of the apparatus according to the invention.

FIGS. 11 and 12 show a rear projection video system 60 that includes a linear reflecting polarizer 62 and an achromatic retarder 64 that allow light in a projected image 66 to reflect from a display screen 68 at one instance and to pass through the screen 68 at another instance. This allows for "optical folding," which allows the video system 60 to be very shallow yet project a large image, as described in the previously incorporated U.S. patent application entitled "Projecting Images." For the video system 60 to work properly, the image source 76 must produce polarized light. A wide variety of other types of video systems employ polarization in image formation.

The reflector electrodes of the present invention are preferably highly reflective, but the light produced by bulbs 11 and 111 is so bright that the surfaces of the reflector electrodes adjacent bulbs 11 and 111 can be white and the reflector electrodes would still work as reflectors.

The foregoing embodiments are presented by way of example only; the scope of the prsent invention is to be limited only by the following claims.

What is claimed as invention is:

1. A high power discharge lamp apparatus comprising:

an electrodeless bulb that includes a chamber;

a fill contained within the chamber in the bulb; and at least one reflector electrode adjacent the bulb for transmitting electromagnetic energy to the fill in the bulb to excite the fill and cause it to radiate light and for reflecting the light radiated by the fill, wherein a diffusely reflecting material is deposited on the at least one reflector electrode.

2. The lamp apparatus of claim 1, wherein the bulb is made of quartz.

3. The lamp apparatus of claim 1, wherein the bulb is made of sapphire.

4. The lamp apparatus of claim 1, wherein the reflector electrode comprises metal.

5. The lamp apparatus of claim 1, wherein the reflector electrode comprises metal deposited on the bulb.

6. The lamp apparatus of claim 1, wherein the bulb is a quartz envelope.

7. The lamp apparatus of claim 1, wherein the bulb is a quartz sphere.

8. The lamp apparatus of claim 1, wherein the bulb is a quartz tube.

9. The lamp apparatus of claim 1, wherein said electromagnetic energy is radio frequency electromagnetic energy.

10. The lamp apparatus of claim 1 further comprising:

a radio frequency energy source connected to said at least one reflector electrode for supplying a radio frequency signal to said at least one reflector electrode.

11. The lamp apparatus of claim 1, wherein the bulb is spherical and wherein the at least one reflector electrode comprises two substantially hemispherical reflector electrodes formed to define an aperture through which light exits the lamp.

12. The lamp apparatus of claim 11, wherein a gap is formed between the two reflector electrodes and wherein a non-conductive reflective material is disposed in the gap.

13. The lamp apparatus of claim 1, wherein the at least one reflector electrode is a single reflector electrode, the lamp further comprising:

an antenna spaced from the bulb.

14. The lamp apparatus of claim 13, further comprising:

a mirror disposed between the bulb and the antenna.

15. The discharge lamp as recited in claim 1, wherein the at least one reflector electrode and the diffusely reflecting material are of suitable respective materials to withstand a relatively high operating temperature of the bulb.

16. The discharge lamp as recited in claim 15, wherein the operating temperature of the bulb is between about 800° C. and 1200° C.

17. A high power discharge lamp apparatus comprising:

an electrodeless bulb that includes a chamber;

a fill contained within the chamber in the bulb; and two reflector electrodes adjacent the bulb for transmitting electromagnetic energy to the fill in the bulb to excite the fill and cause it to radiate light and for reflecting the light radiated by the fill, wherein a diffusely reflecting material is deposited on the two reflector electrodes.

18. The lamp apparatus of claim 17, wherein the bulb is made of quartz.

19. The lamp apparatus of claim 17, wherein the two reflector electrodes comprise metal.

20. The lamp apparatus of claim 17, wherein the two reflector electrodes comprise metal deposited on the bulb.

21. The lamp apparatus of claim 17, wherein the bulb is a quartz envelope.

22. The lamp apparatus of claim 17, wherein the bulb is a quartz sphere.

23. The lamp apparatus of claim 17, wherein the bulb is a quartz tube.

24. The lamp apparatus of claim 17, wherein said electromagnetic energy is radio frequency electromagnetic energy.

25. The lamp apparatus of claim 17 further comprising:

a radio frequency energy source connected to said two reflector electrodes for supplying a radio frequency signal to said two reflector electrodes.

26. The lamp apparatus of claim 17, wherein a gap is formed between the two reflector electrodes and wherein a non-conductive reflective material is disposed in the gap.

27. The discharge lamp as recited in claim 17, wherein the two reflector electrodes and the diffusely reflecting material are of suitable respective materials to withstand a relatively high operating temperature of the bulb.

28. The discharge lamp as recited in claim 27, wherein the operating temperature of the bulb is between about 800° C. and 1200° C.

29. A high power discharge lamp apparatus comprising:

an electrodeless bulb that includes a chamber;

a fill contained within the chamber in the bulb; and two reflector electrodes adjacent the bulb for transmitting electromagnetic energy to the fill in the bulb to excite the fill and cause it to radiate light and for reflecting the light radiated by the fill, wherein the bulb is a tube having a first end and a second end, and the two reflector electrodes extend along the length of the tube and have respective ends which are spaced from the first end and the second end of the tube, wherein the first and second ends of the tube remain relatively cool during operation as compared to the center of the tube.

30. The lamp apparatus of claim 29, wherein a gap is formed between the two reflector electrodes and wherein a non-conductive reflective material is disposed in the gap.

31. The discharge lamp as recited in claim 29, wherein the two reflector electrodes are of suitable respective materials to withstand a relatively high operating temperature of the center of the tube.

32. The discharge lamp as recited in claim 31, wherein the operating temperature of the center of the tube is between about 800° C. and 1200° C.

33. A high power discharge lamp apparatus comprising:

an electrodeless bulb that includes a chamber;

a fill contained within the chamber in the bulb; and two reflector electrodes adjacent the bulb for transmitting electromagnetic energy to the fill in the bulb to excite the fill and cause it to radiate light and for reflecting the light radiated by the fill, wherein a gap is formed between the two reflector electrodes and wherein a non-conductive reflective material is disposed in the gap.

34. The discharge lamp as recited in claim 33, wherein the two reflector electrodes and the non-conductive reflective material are of suitable respective materials to withstand a relatively high operating temperature of the bulb.

35. The discharge lamp as recited in claim 34, wherein the operating temperature of the bulb is between about 800° C. and 1200° C.

* * * * *